US008763312B2

(12) United States Patent
Carter

(10) Patent No.: US 8,763,312 B2
(45) Date of Patent: Jul. 1, 2014

(54) SLAT WALL SYSTEMS

(76) Inventor: Gary Keith Carter, Maricopa, AZ (US)

( * ) Notice: Subject to any disclaimer, the term of this patent is extended or adjusted under 35 U.S.C. 154(b) by 0 days.

(21) Appl. No.: 13/018,246

(22) Filed: Jan. 31, 2011

(65) Prior Publication Data

US 2011/0185667 A1 Aug. 4, 2011

Related U.S. Application Data

(60) Provisional application No. 61/300,008, filed on Jan. 31, 2010.

(51) Int. Cl.
*E04F 19/00* (2006.01)

(52) U.S. Cl.
USPC ..... 52/36.5; 52/36.1

(58) Field of Classification Search
CPC .. A47F 5/0846; A47F 5/0018; E04F 13/0864; E04F 13/0803; E04F 13/0862; E04F 13/0894; E04F 2203/04
USPC ..... 52/36.1, 36.4–36.6; D25/123, 138
See application file for complete search history.

(56) References Cited

U.S. PATENT DOCUMENTS

| | | | | | |
|---|---|---|---|---|---|
| 4,890,433 | A * | 1/1990 | Funaki | 52/386 |
| 4,961,295 | A | 10/1990 | Kosch, Sr. et al. | |
| 5,050,362 | A * | 9/1991 | Tal et al. | 52/588.1 |
| 5,899,344 | A | 5/1999 | Current et al. | |
| 5,941,026 | A * | 8/1999 | Eisenreich et al. | 52/36.5 |
| 6,134,846 | A * | 10/2000 | Lamb | 52/36.5 |
| 6,945,414 | B1 * | 9/2005 | Stevens et al. | 211/94.01 |
| 7,175,034 | B2 * | 2/2007 | Nook et al. | 211/189 |
| 7,296,695 | B2 * | 11/2007 | Perkins et al. | 211/94.01 |
| 7,306,107 | B2 * | 12/2007 | Secondino | 211/94.01 |
| 7,464,511 | B2 | 12/2008 | Kosch | |
| 7,571,571 | B1 * | 8/2009 | Mershon | 52/36.5 |
| D613,520 | S | 4/2010 | Goodman | |
| D648,448 | S * | 11/2011 | Apgood et al. | D25/138 |
| D649,267 | S * | 11/2011 | Apgood et al. | D25/138 |
| 8,117,801 | B2 * | 2/2012 | Jambois et al. | 52/748.1 |
| 8,336,273 | B2 * | 12/2012 | Enns | 52/588.1 |
| 8,584,425 | B2 * | 11/2013 | Wagner et al. | 52/588.1 |
| 2005/0006539 | A1 * | 1/2005 | Fischer et al. | 248/220.42 |
| 2005/0127016 | A1 * | 6/2005 | Fischer | 211/94.01 |
| 2005/0193641 | A1 * | 9/2005 | Fischer | 52/36.5 |
| 2006/0091094 | A1 * | 5/2006 | Schuberth | 211/94.01 |
| 2008/0105637 | A1 * | 5/2008 | Lawson | 211/94.01 |
| 2010/0122505 | A1 * | 5/2010 | Jakiel | 52/483.1 |
| 2012/0199708 | A1 * | 8/2012 | Convey | 248/201 |

* cited by examiner

*Primary Examiner* — Elizabeth A Plummer
(74) *Attorney, Agent, or Firm* — Keith L. Jenkins, Registered Patent Attorney, LLC; Keith L. Jenkins

(57) ABSTRACT

A combination of interlocking primary, top, and bottom interlocking panels (or slats) and slat wall pegs, where the primary panels each have two horizontal spaced-apart slots positioned such that the spacing between slots on a panel and slots across a panel boundary is the same. The interlocking features conceal fasteners that are used proximate the interlock, providing an improved appearance. The top panels attach by spring clips for manual installation and removal. The bottom panels fasten to the wall. Attachment flanges on primary and bottom panels have a groove for fastener alignment. The pegs have resilient arcuate bases with a top flange for engaging a flange channel in the top of a slot and a bottom flange for engaging a floor and back wall of a lower slot. Pegs may be slotted for ease of storage.

20 Claims, 6 Drawing Sheets

SLAT WALL SYSTEMS

RELATED APPLICATIONS

This application claims the benefit of U.S. Provisional Patent Application Ser. No. 61/300,008 filed Jan. 31, 2010 to the same inventor.

FIELD OF THE INVENTION

This invention relates to a slat wall system for storing tools and other objects on a wall having movable protrusions of various sorts. The invention further relates to a slat wall system in which the means for fastening the slat wall panels to a wall are concealed in the installed product.

BACKGROUND

Slat walls of various designs are on the market, but are not aesthetically pleasing to some, as the fasteners for fastening the slat wall panels are visible after installation. In addition, some designs create asymmetries that prevent attachment of pegs across panel boundaries, thereby limiting the options of the user. Some slat wall designs engage peg supports in a single slot on the slat wall, thereby reducing stability.

Therefore, a need exists for a slat wall system that conceals fasteners used for installation. A need also exists for a slat wall system that provides double-slot support for peg supports. A need exists for a slat wall system that is easy to install. A need exists for a slat wall system that creates symmetry allowing double-slot peg supports to be installed across panel boundaries. A need exists for a slat wall system that is easy to manufacture. A need exists for a slat wall system that presents a pleasing and finished appearance.

OBJECTS AND FEATURES OF THE INVENTION

A primary object and feature of the present invention is to overcome the above-mentioned problems and fulfill the above-mentioned needs.

Another object and feature of the present invention is to provide a slat wall system that conceals fasteners used for installation. Another object and feature of the present invention is to provide a slat wall system that provides double-slot support for peg supports. Another object and feature of the present invention is to provide a slat wall system that is easy to install. Another object and feature of the present invention is to provide a slat wall system that creates symmetry allowing double-slot peg supports to be installed across panel boundaries. Another object and feature of the present invention is to provide a slat wall system that is easy to manufacture. Another object and feature of the present invention is to provide a slat wall system that presents a pleasing and finished appearance It is an additional primary object and feature of the present invention to provide slat wall system that is safe, inexpensive, easy to clean, and handy. Other objects and features of this invention will become apparent with reference to the following descriptions.

SUMMARY OF THE INVENTION

In accordance with a preferred embodiment hereof, the present invention provides a slat wall system that conceals fasteners in the finished installation, provides double-slot peg supports within and across panels, and is easy to manufacture and install.

The invention provides a slat wall system including: a plurality of primary panels, each having a top end and a bottom end, where the bottom end of a first primary panel of the plurality of primary panels is configured to interlock with the top end of a second primary panel of the plurality of primary panels; a bottom panel operable to interlock to the bottom end; a top panel operable to interlock to the top end; and where the interlocking conceals fasteners when at least two of the plurality of primary panels, the bottom panel, and the top panel are interlocked and fastened to a wall. The slat wall system, where the plurality of primary panels each includes top and bottom spaced-apart horizontal slots having a particular spacing defined by a main panel portion; and where interlocking top and bottom primary panels of the plurality of primary panels retain the particular spacing between a top slot of the bottom primary panel and a bottom slot of the top primary panel. The slat wall system, where the top end includes: a vertical attachment flange having a flat, wall-engaging rear surface; a top end; and a front surface; a horizontal groove in the front surface; a standoff, extending from the attachment flange front surface, sized to accommodate a fastener head; a channel, adjacent and below the standoff, having an irregular trapezoidal cross-section; and a top support, extending from a side of the channel distal the standoff, for supporting an interlockable primary panel or an interlockable top panel; and a top semi-panel portion, extending downward from the top support to an opening of a top horizontal slot in the primary panel. The slat wall system, including a main panel portion extending from a floor of a top horizontal slot in the primary panel to a top of an opening of a bottom horizontal slot. The slat wall system, where the bottom end includes: a bottom semi-panel, having a front surface and a rear surface, extending from a floor of a bottom horizontal slot in the primary panel; a horizontal support extending rearward from the bottom semi-panel portion operable to abut a top support of one of an interlockable primary panel and an interlockable bottom panel; a foot flange, having an irregular trapezoidal cross-section, extending downward from the horizontal support; and a rear support extending from the semi-panel portion rear surface, positioned and sized to abut a top end of an attachment flange of one of an interlockable primary panel and an interlockable bottom panel. The slat wall system, where each primary panel is made from a single web having a web thickness. The slat wall system, where each primary panel, the top panel, and the bottom panel has a thickness equal to two and two-thirds the web thickness. The slat wall system, where each slot of the top and bottom spaced-apart horizontal slots includes: an opening having a top and a bottom, the opening positioned between a main panel portion and a semi-panel portion of the primary panel; a floor extending inward from the bottom opening; and a linear flange extending upward from the opening, creating an upwardly extending flange channel behind the linear flange. The slat wall system, including a peg having a resilient arcuate base adapted to be coupled between two the horizontal slots in at least one primary panel. The slat wall system, where the peg further includes: an upward flange extending from a top of the resilient arcuate base, where the flange is sized to engage an upwardly extending flange channel in the first, upper, horizontal slot; and an upturned flange extending from a bottom of the resilient arcuate base and sized to engage a floor of the second, lower horizontal slot; and at least one elongated member coupled to and extending rigidly outward from the base; where the resilient arcuate base is one of: entire; slotted above the at least one elongated member; and channeled proximate at least one side of the resilient arcuate base.

A slat wall system including: a plurality of primary panels, each having a top end and a bottom end, where the bottom end of a first primary panel of the plurality of primary panels is configured to interlock with the top end of a second primary panel of the plurality of primary panels; top and bottom horizontal spaced-apart slots, having a particular spacing defined by a main panel portion, in each primary panel of the plurality of primary panels; a bottom panel operable to interlock to the bottom end; a top panel operable to interlock to the top end; where the interlocking conceals a fastener when at least two of the plurality of primary panels, the bottom panel, and the top panel are interlocked and fastened to a wall; where interlocking top and bottom primary panels of the plurality of primary panels retains the particular spacing between a top slot of the bottom panel and a bottom slot of the top panel; a main panel portion extending from a floor of a top horizontal slot in each primary panel of the plurality of primary panels to a top of an opening of a bottom horizontal slot in each primary panel of the plurality of primary panels. The slat wall system, where the top end of each primary panel of the plurality of primary panels includes: an attachment flange having a flat, wall-engaging rear surface, a top end, and a front surface; a horizontal groove in the front attachment flange front surface; a standoff, extending from the attachment flange front surface, sized to accommodate a fastener head; a channel, adjacent and below the standoff, having an irregular trapezoidal cross-section; and a top support, extending from a side of the channel distal the standoff, for supporting one of an interlockable primary panel and an interlockable top panel; and a top semi-panel portion, extending downward from the top support to the opening of the top horizontal slot. The slat wall system, where the bottom end includes: a bottom semi-panel, having a front surface and a rear surface, extending from a floor of the bottom horizontal slot in the primary panel; a horizontal support extending rearward from the bottom semi-panel portion, operable to abut a top support one of: a particular interlockable primary panel of the plurality of primary panels; and the interlockable bottom panel; a foot flange, having an irregular trapezoidal cross-section, extending downward from the horizontal support; and a rear support extending from the semi-panel portion rear surface, positioned and sized to engage a top end of an attachment flange of one of: a particular interlockable primary panel of the plurality of primary panels; and the interlockable bottom panel. The slat wall system, where each primary panel is made from a single web having a web thickness. The slat wall system, where each primary panel, the top panel, and the bottom panel has a thickness equal to two and two-thirds the web thickness. The slat wall system, where each slot of the top and bottom spaced-apart horizontal slots includes: an opening having a top and a bottom, the opening positioned between a main panel portion and a semi-panel portion of the primary panel; a floor extending inward from the bottom of the opening; and a linear flange extending upward from the opening, creating an upwardly extending flange channel behind the linear flange. The slat wall system, including a peg having a resilient arcuate base adapted to be coupled between two the spaced apart horizontal slots in at least one primary panel. The slat wall system, where the peg further includes: an upward flange extending from a top of the resilient arcuate base, where the flange is sized to engage an upwardly extending flange channel in the first, upper, horizontal slot; and an upturned flange extending from a bottom of the resilient arcuate base and sized to engage a floor of the second, lower horizontal slot; and at least one elongated member coupled to and extending rigidly outward from the base; where the resilient arcuate base is one of: entire; slotted above the at least one elongated member; and channeled proximate at least one side of the resilient arcuate base.

A slat wall system including: a plurality of primary panels, each having a top end and a bottom end, where the bottom end of a first primary panel of the plurality of primary panels is configured to interlock with the top end of a second primary panel of the plurality of primary panels; where: the top end includes: a vertical attachment flange having a flat, wall-engaging rear surface; a top end; and a front surface; a horizontal groove in the front surface; a standoff, extending from the attachment flange front surface, sized to accommodate a fastener head; a channel, adjacent and below the standoff, having an irregular trapezoidal cross-section; a top support, extending from a side of the channel distal the standoff, for supporting one of an interlockable primary panel and an interlockable top panel; and a top semi-panel portion, extending downward from the top support to an opening of a top horizontal slot in the primary panel; the bottom end includes: a bottom semi-panel, having a front surface and a rear surface, extending from a floor of a bottom horizontal slot in the primary panel; a horizontal support extending rearward from the bottom semi-panel portion operable to abut a top support of one of an interlockable primary panel and an interlockable bottom panel; a foot flange, having an irregular trapezoidal cross-section, extending downward from the horizontal support; and a rear support extending from the semi-panel portion rear surface, positioned and sized to abut a top end of an attachment flange of one of an interlockable primary panel and an interlockable bottom panel; top and bottom horizontal spaced-apart slots, having a particular spacing defined by a main panel portion extending from a floor of a top horizontal slot in the primary panel to a top of an opening of a bottom horizontal slot, in each primary panel of the plurality of primary panels; where each slot of the top and bottom spaced-apart horizontal slots includes: an opening having a top and a bottom, the opening positioned between a main panel portion and a semi-panel portion of the primary panel; a floor extending inward from the bottom opening; and a linear flange extending upward from the opening, creating an upwardly extending flange channel behind the linear flange a bottom panel operable to interlock to the bottom end, where the bottom panel includes: a vertical bottom panel attachment flange having a flat, wall-engaging rear surface, a top end, and a front surface; a horizontal groove in the front surface; a standoff, extending from the bottom panel attachment flange front surface, sized to accommodate a fastener head; a bottom panel channel, adjacent and below the standoff, having an irregular trapezoidal cross-section; a bottom panel top support, extending from a side of the channel distal the standoff, for supporting an interlockable primary panel; and a bottom panel front surface descending from the bottom panel top support; where the interlocking conceals fasteners when at least two of the plurality of primary panels, the bottom panel, and the top panel are interlocked and fastened to a wall; where interlocking top and bottom primary panels of the plurality of primary panels retain the particular spacing between a top slot of the bottom panel and a bottom slot of the top panel; a main panel portion extending from a floor of a top horizontal slot in each primary panel of the plurality of primary panels to a top of an opening of a bottom horizontal slot in each primary panel of the plurality of primary panels; and where each primary panel is made from a single web having a web thickness and each primary panel, the top panel, and the bottom panel has a thickness equal to two and two-thirds the web thickness. The slat wall system, including a peg having a resilient arcuate base adapted to be coupled between two the horizontal slots in at least one primary panel; where the peg further includes: an upward flange extending from a top of the resilient arcuate base, where the flange is sized to engage an upwardly extending flange channel in the first, upper, horizontal slot; and an upturned flange extending from a bottom of the resilient arcuate base and sized to engage a floor of the second, lower horizontal slot; and at least one elongated member coupled to and extending rigidly outward from the base; where the resilient arcuate base is one of: entire; slotted above the at least one elongated member; and channeled proximate at least one side of the resilient arcuate base.

BRIEF DESCRIPTION OF THE DRAWINGS

The above and other objects and advantages of the present invention will become more apparent from the following description taken in conjunction with the following drawings in which.

DETAILED DESCRIPTION OF THE BEST MODES AND PREFERRED EMBODIMENTS OF THE INVENTION

Figures 1, 2, 3, 4, 5, 6, 7, 8:
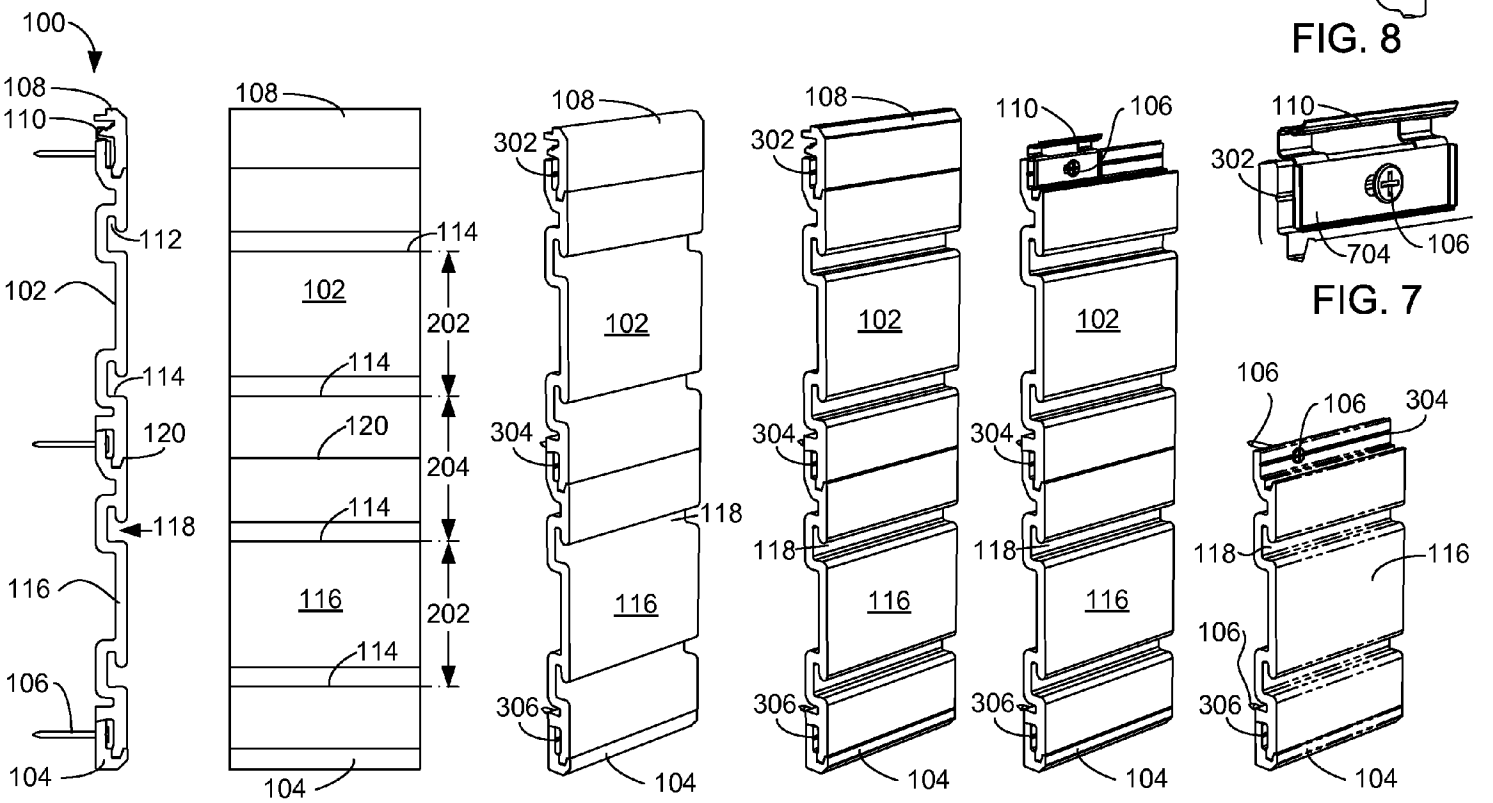
FIG. 1 is a side elevation view illustrating an exemplary slat wall system, according to a preferred embodiment of the present invention.
FIG. 2 is a front elevation view illustrating an exemplary slat wall system, according to the preferred embodiment of FIG. 1.
FIG. 3 is a front-side perspective view illustrating an exemplary slat wall system, according to the preferred embodiment of FIG. 1.
FIG. 4 is a front-side shaded perspective view illustrating an exemplary slat wall system, according to the preferred embodiment of FIG. 1.
FIG. 5 is a front-side shaded perspective view illustrating positioning of a clip of an exemplary slat wall system, according to the preferred embodiment of FIG. 1.
FIG. 6 is a front-side shaded perspective view illustrating one panel of an exemplary slat wall system, according to the preferred embodiment of FIG. 1.
FIG. 7 is a front-side shaded perspective view illustrating details of an exemplary clip of an exemplary slat wall system, according to the preferred embodiment of FIG. 1.
FIG. 8 is side elevation view illustrating details of an exemplary clip of an exemplary slat wall system, according to the preferred embodiment of FIG. 1.

FIG. 1 is a side elevation view illustrating an exemplary slat wall system 100, according to a preferred embodiment of the present invention. The present invention provides a slat wall system 100 with first and second primary panels 116 and 102, a bottom panel 104, and a top panel 108. Top panel 108 is attached with the aid of a clip 110 (see FIGS. 7 and 8 for detail). The panels 104, 116, 102, and 108 are attached to a wall using fasteners 106 (one of three labeled). The panels 104, 116, 102, and 108 are made of a substantially rigid material. Each primary panel 102 and 116 has two slots 118 (one of four labeled), and each slot 118 has a floor 114 (one of four labeled) and a flange channel 112 (one of four labeled). A seam 120 is formed by joining panels 116 and 102. Various numbers of primary panels 102 and 116 may be connected together to create a slat wall system 100 of any desired height.

FIG. 2 is a front elevation view illustrating an exemplary slat wall system, according to the preferred embodiment of FIG. 1. Floors 114 are equally spaced apart within 202 primary panels 102 and 116, as well as between 204 primary panels 116 and 102. That is, intra-panel slot 118 spacing 202 is the same as inter-panel slot spacing 204.

FIG. 3 is a front-side perspective view illustrating an exemplary slat wall system 100, according to the preferred embodiment of FIG. 1. Groove 302, into which fasteners 106, illustrated as screws 106, penetrate, is proximate and parallel to the top edges of primary panels 116 and 102, as well as bottom panel 104. The groove 302 provides assistance in drilling holes for fasteners 106, which may be performed during manufacture or installation. Groove 304 performs the same function in primary panel 116 and groove 306 performs the same function in bottom panel 104.

FIG. 4 is a front-side shaded perspective view illustrating an exemplary slat wall system 100, according to the preferred embodiment of FIG. 1. The curvature of the panels 104, 102, 116, and 108 may be better visualized in this illustration.

FIG. 5 is a front-side shaded perspective view illustrating positioning of a clip 110 of an exemplary slat wall system 100, according to the preferred embodiment of FIG. 1. Clip 110 is of resilient metal or the like and is fastened by fastener 106 to a top edge of first primary panel 102, as shown. Clip 110 receives (snap fits) a protrusion 802 (See FIG. 8) on the rear side of top panel 108 to assist in securing top panel 108.

FIG. 6 is a front-side shaded perspective view illustrating one panel 116 of an exemplary slat wall system 100, according to the preferred embodiment of FIG. 1. The relationship of groove 304 and screw 106 can be clearly seen in this illustration. Bottom panel 104 is shown attached to primary panel 116.

FIG. 7 is a front-side shaded perspective view illustrating details of an exemplary clip of an exemplary slat wall system 100, according to the preferred embodiment of FIG. 1. Metal clip 110 is clamped by block 704 and secured with screw 106 through block 704 and groove 302 of primary panel 102.

FIG. 8 is side elevation view illustrating details of an exemplary clip of an exemplary slat wall system 100, according to the preferred embodiment of FIG. 1. Metal clip 110 is clamped by block 704 and secured with screw 106 through block 704 and groove 302 of primary panel 102. Protrusion 802 has a détente in its upper surface for engaging and angled portion of the clip 110, to ensure a firm hold.

Figure 9:
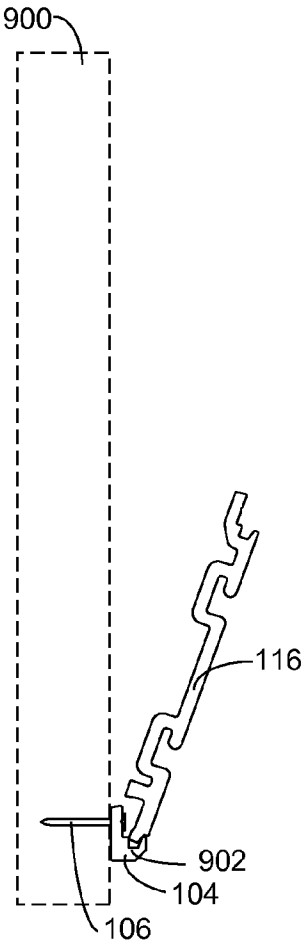
FIG. 9 is a side elevation view illustrating a step in the installation of an exemplary slat wall system, according to the preferred embodiment of FIG. 1.

FIG. 9 is a side elevation view illustrating a step in the installation of an exemplary slat wall system 100, according to the preferred embodiment of FIG. 1. Bottom panel 104 is leveled and attached to wall 900 with screw 106. A bottom edge of primary panel 116 is inserted into bottom panel groove 902 at an acute angle to the wall 900.

Figure 10:
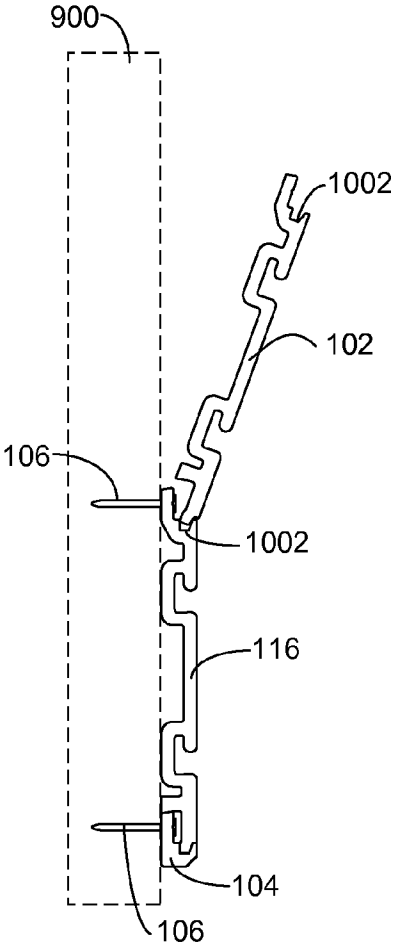
FIG. 10 is a side elevation view illustrating another step in the installation of an exemplary slat wall system, according to the preferred embodiment of FIG. 1.

FIG. 10 is a side elevation view illustrating another step in the installation of an exemplary slat wall system 100, according to the preferred embodiment of FIG. 1. The top end of primary panel 116 is secured to the wall 900 with screw 106 and the bottom edge of primary panel 102 is inserted in primary panel 116 channel 1002. Note that there is no practical limit as to how many primary panels 116 and 102 may be connected in this way. The use of two primary panels 102 and 116 is merely exemplary.

Figure 11:
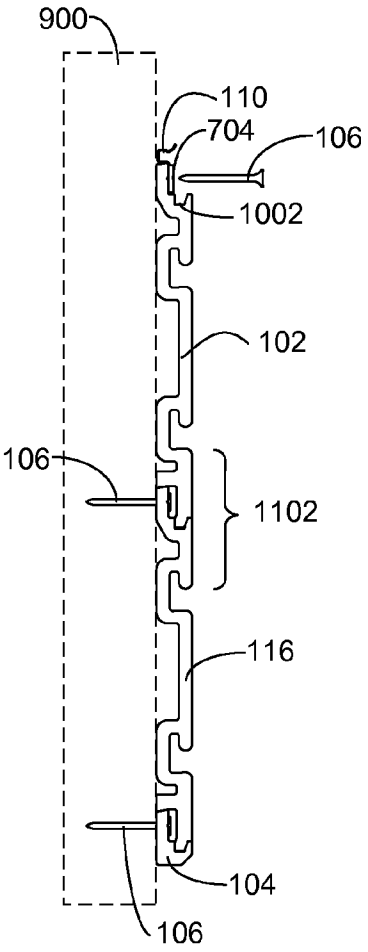
FIG. 11 is a side elevation view illustrating another step in the installation of an exemplary slat wall system, according to the preferred embodiment of FIG. 1.

FIG. 11 is a side elevation view illustrating another step in the installation of an exemplary slat wall system 100, according to the preferred embodiment of FIG. 1. Panel 102 is pressed into place against wall 900 and clip 110 is held in position with block 704 to receive screw 106. Block 704 may, in a particular embodiment, be integral to clip 110. Primary panel 102 channel 1002 is not intruded upon by the fastened clip 110 and block 704. Panel 1102, formed by meeting semi-panel portions (2302 and 2320, see FIG. 23) ends of primary panels 102 and 116, is the same height as each of primary panels 102 and 116.

Figure 12:
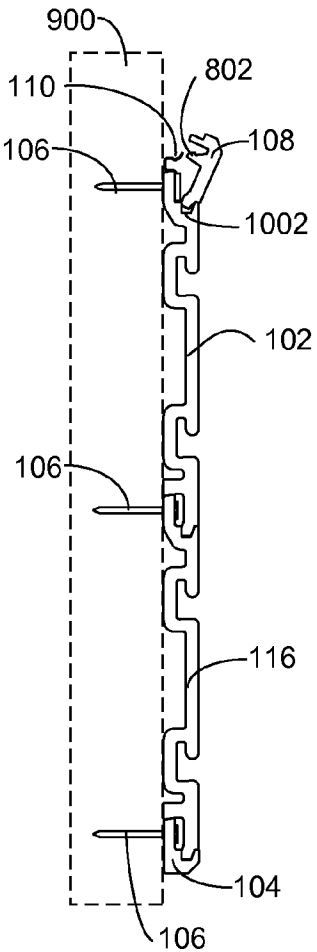
FIG. 12 is a side elevation view illustrating another step in the installation of an exemplary slat wall system, according to the preferred embodiment of FIG. 1.

FIG. 12 is a side elevation view illustrating another step in the installation of an exemplary slat wall system 100, according to the preferred embodiment of FIG. 1. Screw 106 is screwed into wall 900 in order to secure the top end of primary panel 102, the clip 110, and the block 704. In some embodiments, block 704 may be integral with clip 110. A bottom edge of top panel 108 is inserted into second primary panel 102 channel 1002 and pressed inward to engage a protrusion 802 on the back of top panel 108 with clip 110.

Figure 13:
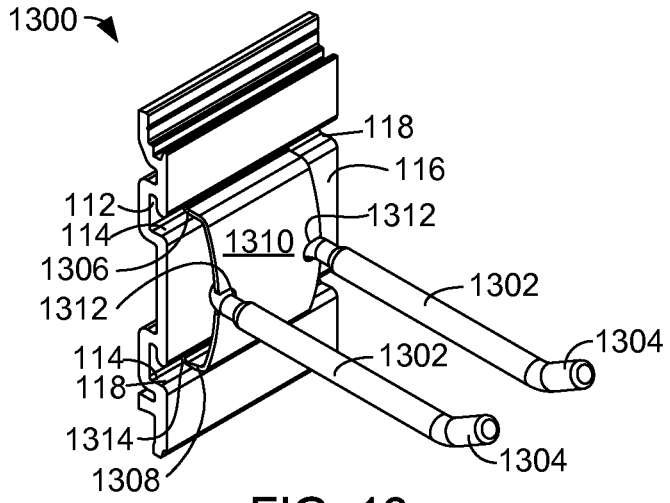
FIG. 13 is a front-side perspective view illustrating an exemplary first peg for use as part of an exemplary slat wall system, according to a preferred embodiment.
Figure 26A:
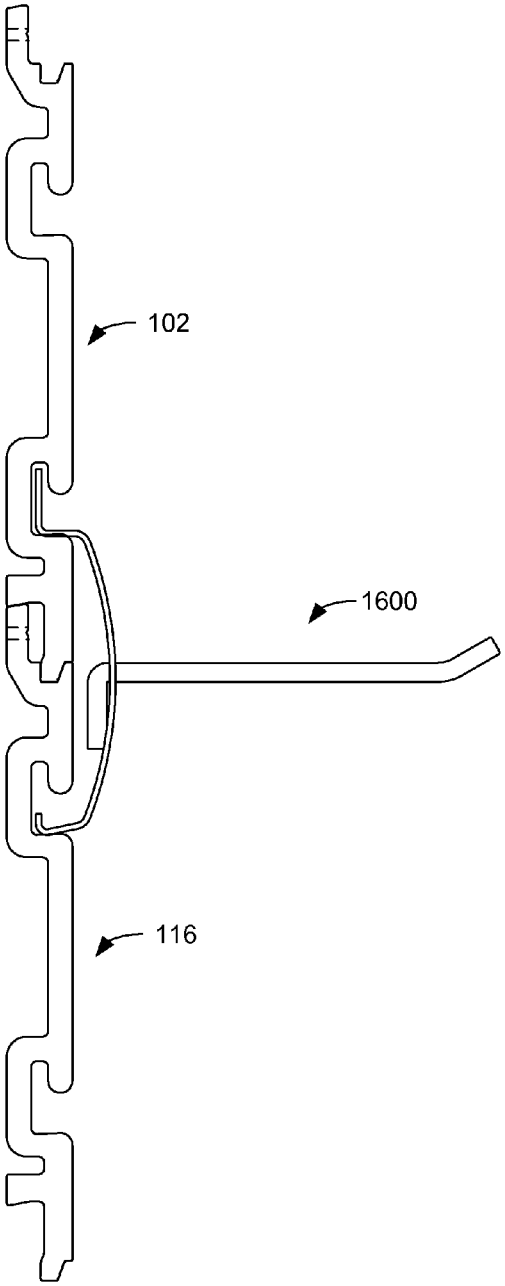
FIG. 26A is a side elevation cross-sectional view illustrating an exemplary interlocked pair of primary panels of the exemplary slat wall system, according to the preferred embodiment of FIG. 1.

FIG. 13 is a front-side perspective view illustrating an exemplary first peg 1300 for use as part of an exemplary slat wall system 100, according to a preferred embodiment. First peg 1300 engages two slots 118 on primary panel 116. Panel base 1310 is an arcuate panel of resilient material with side flange channels 1312 to accommodate U-shaped arms 1302 with inclined tips 1304. The arm base 1402 (see FIG. 14) of the U-shaped arms 1302 is behind base 1310 in this view. Floor-rest 1308 engages floor 114 of the lower slot 118, and an upturned flange 1314, extending upward from floor rest 1308, abuts the rear surface of the slot 118. Flange 1306 engages floor 114 of upper slot 118 and also enters flange channel 112 of upper slot 118. The base panel 1310 is deformed against its resilient bias to fit in slots 118, and the resilience helps keep first peg 1300 in place. Just as exemplary first peg 1300 fits over panel 116, it will also fit over panel 1102, panel 102, and the like. It should be appreciated that, while first peg 1300 is illustrated as being installed on a single primary panel 102, the same installation could be made between a top slot 118 in a lower primary panel 116 and a bottom slot 118 of an upper primary panel 102, as best illustrated in FIG. 26A. Another advantage of the slat wall system 100 is that the slots 118 are all equally spaced apart both within and between primary panels 102 and 116, allowing a higher degree of flexibility in placement of first pegs 1300 than prior art systems that use unequal spacing.

Figure 14:
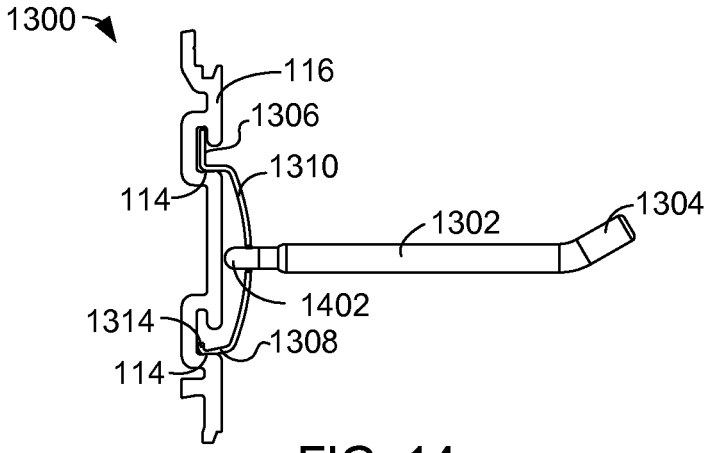
FIG. 14 is a side elevation view illustrating an exemplary first peg for use as part of an exemplary slat wall system, according to the preferred embodiment of FIG. 13.

FIG. 14 is a side elevation view illustrating an exemplary first peg 1300 for use as part of an exemplary slat wall system 100, according to the preferred embodiment of FIG. 13. Floor-rest 1308 engages floor 114 of the lower slot 118, and an upturned flange 1314, extending upward from floor rest 1308, abuts the rear surface of the slot 118. Flange 1306 engages floor 114 of upper slot 118 and also enters flange channel 112 of upper slot 118.

Figure 15:
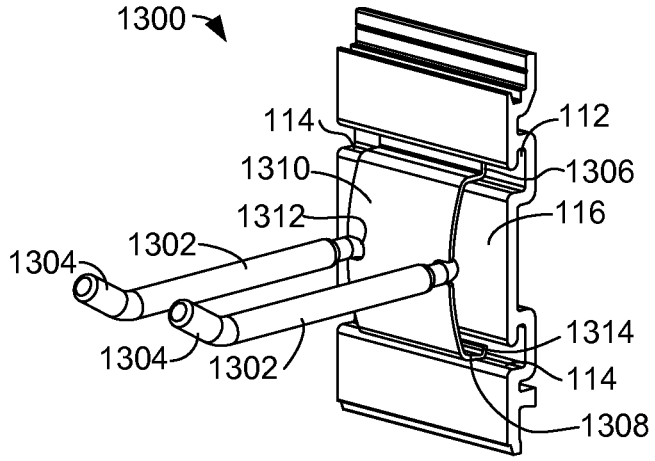
FIG. 15 is a front-side perspective view illustrating an exemplary first peg for use as part of an exemplary slat wall system, according to the preferred embodiment of FIG. 13.

FIG. 15 is a front-side perspective view illustrating an exemplary first peg 1300 for use as part of an exemplary slat wall system 100, according to the preferred embodiment of FIG. 13. First peg 1300 engages two slots 118 on panel 116. Base 1310 is an arcuate panel of resilient material with side flange channels 1312 to accommodate U-shaped arms 1302 with inclined tips 1304. The base of the U-shaped arms 1302 is behind base 1310 in this view. Floor-rest 1308 engages floor 114 of the lower slot 118, and flange 1306 engages floor 114 of upper slot 118 and also enters flange channel 112 of upper slot 118. The base panel 1310 is deformed against its resilient bias to fit in slots 118, and the resilience helps keep first peg 1300 in place.

Figure 16:
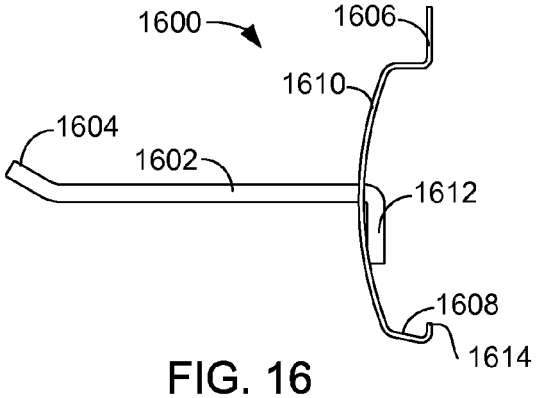
FIG. 16 is a side elevation view illustrating an exemplary second peg for use as part of an exemplary slat wall system, according to a preferred embodiment.

FIG. 16 is a side elevation view illustrating an exemplary second peg 1600 for use as part of an exemplary slat wall system 100, according to a preferred embodiment. Resilient arcuate base panel 1610 supports arm 1602 with upwardly inclined tip 1604. Base panel 1610 has a top flange 1606 and a bottom floor rest 1608 that extends into an upturned flange 1614 for abutting a rear wall of slot 118. Hook 1612 is attached to the back of base panel 1610, my means appropriate to the materials selected (welding, gluing, etc).

Figure 17:
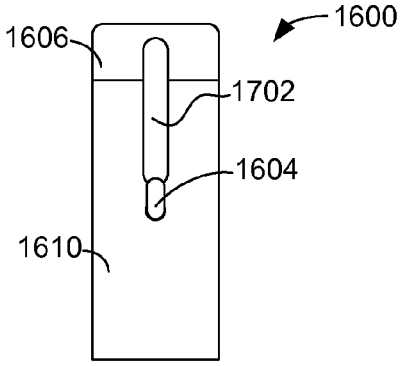
FIG. 17 is a front elevation view illustrating an exemplary second peg for use as part of an exemplary slat wall system, according to the preferred embodiment of FIG. 16.

FIG. 17 is a front elevation view illustrating an exemplary second peg 1600 for use as part of an exemplary slat wall system 100, according to the preferred embodiment of FIG. 16. Opening 1702 allows second pegs 1600 to be stacked for shipping and storage, as will be discussed in greater detail below.

Figure 18:
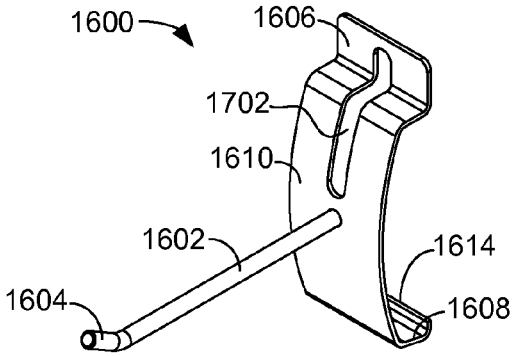
FIG. 18 is a front-side perspective view illustrating an exemplary second peg for use as part of an exemplary slat wall system, according to the preferred embodiment of FIG. 16.

FIG. 18 is a front-side perspective view illustrating an exemplary second peg 1600 for use as part of an exemplary slat wall system 100, according to the preferred embodiment of FIG. 16. Opening 1702 extends into top flange 1606.

Figure 19:
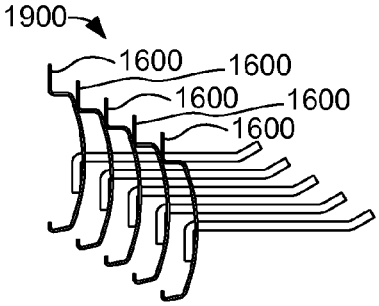
FIG. 19 is a side elevation view illustrating an exemplary stack of exemplary second pegs for use as part of an exemplary slat wall system, according to a preferred embodiment of FIG. 16.

FIG. 19 is a side elevation view illustrating an exemplary stack 1900 of exemplary second pegs 1600 for use as part of an exemplary slat wall system 100, according to a preferred embodiment of FIG. 16. Arms 1602 extend through opening 1702 to make stack 1900 for storage or shipping.

Figure 20:
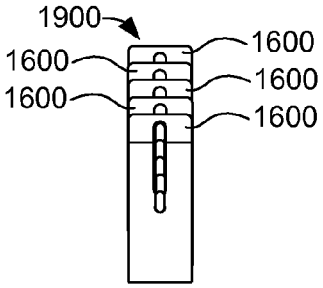
FIG. 20 is a front elevation view illustrating an exemplary stack of exemplary second pegs for use as part of an exemplary slat wall system, according to a preferred embodiment of FIG. 16.

FIG. 20 is a front elevation view illustrating an exemplary stack of exemplary second pegs for use as part of an exemplary slat wall system 100, according to a preferred embodiment of FIG. 16. The number of second pegs 1600 that can be stacked is limited by the height of opening 1702.

Figure 21:
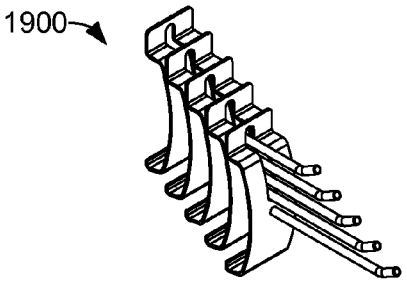
FIG. 21 is a front-side perspective view illustrating an exemplary stack of exemplary second pegs for use as part of an exemplary slat wall system, according to a preferred embodiment of FIG. 16.
Figure 22:
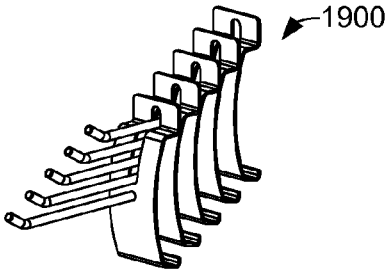
FIG. 22 is a front-side perspective view illustrating an exemplary stack of exemplary second pegs for use as part of an exemplary slat wall system, according to a preferred embodiment of FIG. 16.

FIG. 21 is a front-side perspective view illustrating an exemplary stack of exemplary second pegs 1600 for use as part of an exemplary slat wall system 100, according to a preferred embodiment of FIG. 16; and FIG. 22 is a front-side perspective view illustrating an exemplary stack of exemplary second pegs 1600 for use as part of an exemplary slat wall system 100, according to a preferred embodiment of FIG. 16.

Figure 23:
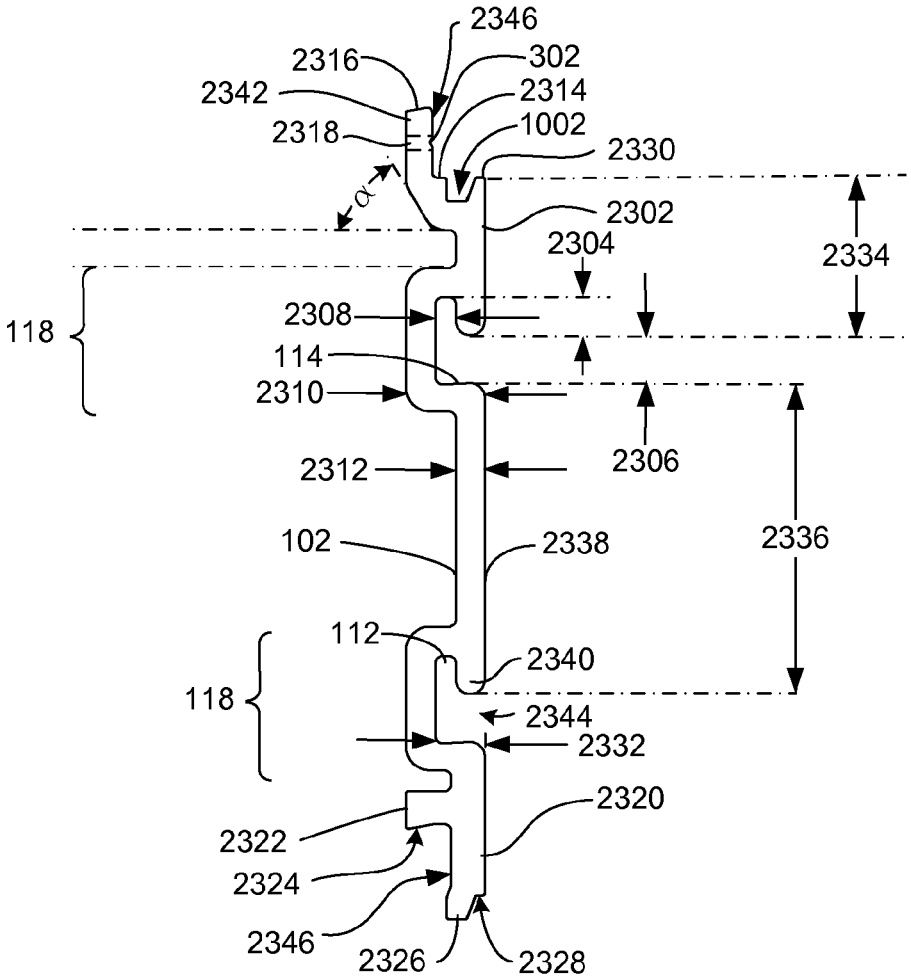
FIG. 23 is a side elevation view illustrating an exemplary panel of the exemplary slat wall system, according to the preferred embodiment of FIG. 1.

FIG. 23 is a side elevation view illustrating an exemplary primary panel 102 of the exemplary slat wall system 100, according to the preferred embodiment of FIG. 1. Primary panel 102 has a web thickness 2312, defined by opposed pairs of arrows. Slot 118 includes flange channel 112, which has a width of approximately two-thirds of the web thickness 2312 and a depth 2304 of approximately one and two-tenths of the web thickness. The floor 114 of slot 118 is slightly (in the range 0.5 to 5 degrees) inclined downward to the rear, and has a width 2332 that is approximately one and two-thirds of the web thickness 2312. The total thickness 2310 of the panel 102 is approximately two and two-thirds of the web thickness 2312. The opening 2344 to slot 118 has a height 2306 of approximately one and one-half web thicknesses 2312. A linear flange 2340 has a web thickness 2312 and a height 2304 of approximately one and two-tenths of the web thickness 2312.

Top end 2316 of attachment flange 2342 supports either a clip 110 for a top panel 108 or engages the under surface 2324 of rear support 2322 on another panel 102. Groove 302 in the front surface 2346 of attachment flange 2342 assists in receiving a screw or other fastener 106 and may provide pre-drilled screw holes 2318 in a particular embodiment. The rear surface of attachment flange 2342 descends from the top end 2316 downward to the level of standoff 2314 and then angles forward by the compliment of $\alpha$. Alpha is about sixty degrees, making the compliment thirty degrees. Standoff 2314 provides room between a top panel 104 or another panel 102 to accommodate the head of a fastener 106, such as screw 106. Channel 1002 receives the foot flange 2326 of another primary panel 102 or the foot flange 2402 (see FIG. 24) of top panel 108. Channel 1002 preferably has an irregular trapezoidal cross-section, as shown. Support 2330 supports a support surface 2328 on another primary panel 102 or on a support surface 2404 on top panel 108.

Semi-panel portions 2302 and 2320 each have a height 2334 which is half of the height of main panel portion 2338. When two primary panels 102 are joined, semi-panel portions 2320 and 2302 together form a structure having the same height 2336 as a main panel portion 2338. Bottom semi-panel portion 2320 ends in support surface 2328 for receiving a support 2330 or 2504 (see FIG. 25), and in a foot flange 2326 for coupling to a channel 1002 in another primary panel 102 or a bottom panel 104. Support 2322 rests on a top end 2316 against its bottom surface 2324 or a on a top end 2514 of a bottom panel 104 when foot flange 2326 is in a channel 1002 of another primary panel 102 or in the channel 2506 of a bottom panel 104.

Figure 24:
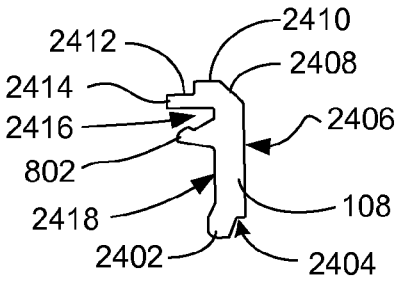
FIG. 24 is a side elevation cross-sectional view illustrating an exemplary top panel of the exemplary slat wall system, according to the preferred embodiment of FIG. 1.

FIG. 24 is a side elevation cross-sectional view illustrating an exemplary top panel 108 of the exemplary slat wall system 100, according to the preferred embodiment of FIG. 1. Front surface 2406 extends upward to beveled corner 2408 which extends to top 2410. Removal channel 2412 assists in removing top panel 108 after installation, if required. Brace 2414 engages a wall, when installed, and is the top to clip channel 2416 which provides room for clip 110, when installed. Protrusion 802 receives clip 110 to couple top panel 108 to attachment flange 2342. Rear surface 2418 forms a wall of a fastener head channel, when installed. Foot 2402 is shaped to be received in channel 1002 and top panel horizontal support 2404 abuts and supports primary panel top support 2330.

Figure 25:
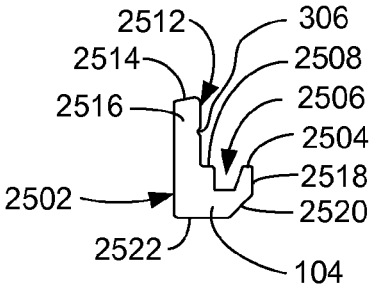
FIG. 25 is a side elevation cross-sectional view illustrating an exemplary bottom panel of the exemplary slat wall system, according to the preferred embodiment of FIG. 1.

FIG. 25 is a side elevation cross-sectional view illustrating an exemplary bottom panel 104 of the exemplary slat wall system 100, according to the preferred embodiment of FIG. 1. Attachment flange 2516 has a rear surface intended to abut the wall, when installed; a top end 2514; and a front surface 2512. Attachment flange front surface 2512 has a horizontal groove 306 for aligning and engaging fasteners 106, such as screws 106. Standoff 2508 provides room for fastener heads and, with bottom panel attachment flange front surface 2512, primary panel bottom end rear surface 2346, and support 2322, provides an enclosure for heads of fasteners 106. Bottom panel channel 2506 receives foot 2326 and bottom end front support 2504 engages bottom end horizontal support surface 2328, when installed. Bottom panel front surface 2518 extends from bottom end front support 2504 to beveled corner 2520. Bottom 2522 of bottom panel 104 may or may not rest on a floor, depending on the installation.

FIG. 26A is a side elevation cross-sectional view illustrating an exemplary interlocked pair of primary panels 102, 116 of the exemplary slat wall system 100, according to the preferred embodiment of FIG. 1. Second peg 1600 is installed in slots 118 on opposite sides of the boundary between primary panel 102 and primary panel 116, which has the same spacing as slots 118 within a primary panel 102 or 116.

Figure 26B:
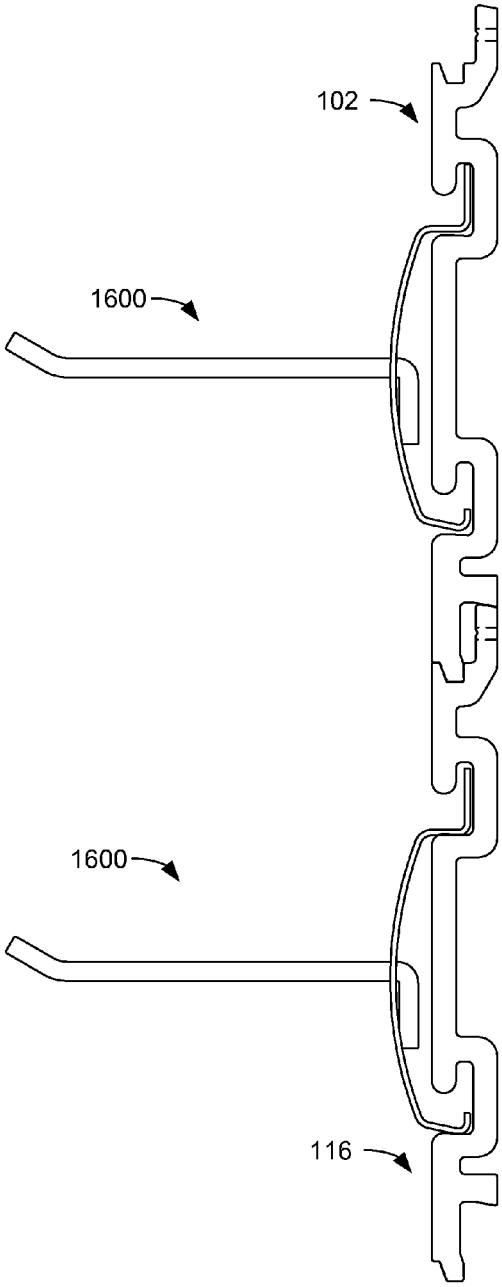
FIG. 26B is a side elevation cross-sectional view illustrating an exemplary interlocked pair of primary panels of the exemplary slat wall system, according to the preferred embodiment of FIG. 1.

FIG. 26B is a side elevation cross-sectional view illustrating an exemplary interlocked pair of primary panels 102, 116 of the exemplary slat wall system 100, according to the preferred embodiment of FIG. 1. Two second pegs 1600 are shown installed in pairs of slots 118 within primary panels 102 and 116, respectively. With horizontal distribution, the same slots 118 may receive pegs 1600 within and across primary panel 102, 116 boundaries.

Primary panels 102 and 116, bottom panels 104 and top panels 108 are each made of a single piece of molded or extruded plastic or composite.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing the exemplary embodiment or exemplary embodiments. It should be understood that various changes can be made in the function and arrangement of elements without departing from the scope of the invention as set forth in the appended claims and the legal equivalents thereof.

In the claims below, words indicating relative direction (top, bottom, front, rear, etc.) are based on the inventive devices being in an installed, vertical position wherein the rear is the side adjacent a wall.

I claim:

1. A slat wall system comprising:

a. a plurality of primary panels, each having a top end and a bottom end, wherein said bottom end of a first primary panel of said plurality of primary panels is configured to interlock with said top end of a second primary panel of said plurality of primary panels;

b. a bottom panel comprising a groove for aligning fasteners and operable to interlock to said bottom end;

c. a top panel that does not receive fasteners and is operable to interlock to said top end;

d. wherein said top end of each said primary panel of said plurality of primary panels comprises a top interlocking portion and a groove for aligning fasteners;

e. wherein said bottom end of each said primary panel of said plurality of primary panels comprises a bottom interlocking portion and does not receive fasteners;

f. wherein interlocking conceals fasteners when at least two of said plurality of primary panels, said bottom panel, and said top panel are interlocked and fastened to a wall; and g. wherein said top panel provides no support for a primary panel of said plurality of primary panels when installed; and f. a resilient clip, wherein said top panel is fastened to said primary panel of said plurality of primary panels with said clip, wherein said clip comprises a flat portion fastened to a top edge of said primary panel of said plurality of primary panels and an arcuately upwardly extending portion receiving a protrusion of said top panel.

2. The slat wall system of claim 1, wherein:

a. said plurality of primary panels each comprises top and bottom spaced-apart horizontal slots having a particular spacing defined by a main panel portion; and b. interlocking top and bottom primary panels of said plurality of primary panels retain said particular spacing between a top slot of said bottom primary panel and a bottom slot of said top primary panel.

3. The slat wall system of claim 2, wherein each said primary panel of said plurality of primary panels is made from a single web having a web thickness.

4. The slat wall system of claim 3, wherein each said primary panel of said plurality of primary panels, said top panel, and said bottom panel has a thickness equal to two and two-thirds said web thickness.

5. The slat wall system of claim 2, wherein each slot of said top and bottom spaced-apart horizontal slots comprises:

a. an opening having a top and a bottom, said opening positioned between a main panel portion and a semi-panel portion of said primary panel;

b. a floor extending inward from said bottom of said opening; and c. a linear flange extending upward from said opening, creating an upwardly extending flange channel behind said linear flange.

6. The slat wall system of claim 2, comprising a peg having a resilient arcuate base adapted to be coupled between two said horizontal slots in at least one primary panel of said plurality of primary panels.

7. The slat wall system of claim 6, wherein said peg further comprises:

a. an upward flange extending from a top of said resilient arcuate base, wherein said flange is sized to engage an upwardly extending flange channel in a first, upper, horizontal slot; and b. an upturned flange extending from a bottom of said resilient arcuate base and sized to engage a floor of a second, lower horizontal slot; and c. at least one elongated member coupled to and extending rigidly outward from said resilient arcuate base;

d. wherein said resilient arcuate base is one of:

i. slotted above said at least one elongated member; and ii. channeled proximate at least one side of said resilient arcuate base.

8. The slat wall system of claim 1, wherein said top end comprises:

a. a vertical attachment flange having a flat, wall-engaging rear surface; a top end; and a front surface;

b. a horizontal groove in said front surface;

c. a standoff, extending from said attachment flange front surface, sized to accommodate a fastener head;

d. a channel, adjacent and below said standoff, having an irregular trapezoidal cross-section;

e. a top support, extending from a side of said channel distal said standoff, for supporting one of an interlockable primary panel and an interlockable top panel; and f. a top semi-panel portion, extending downward from said top support to an opening of a top horizontal slot in said primary panel.

9. The slat wall system of claim 1, comprising a main panel portion extending from a floor of a top horizontal slot in said primary panel to a top of an opening of a bottom horizontal slot.

10. The slat wall system of claim 1, wherein said bottom end comprises:

a. a bottom semi-panel, having a front surface and a rear surface, extending from a floor of a bottom horizontal slot in said primary panel;

b. a horizontal support extending rearward from said bottom semi-panel portion operable to abut a top support of one of an interlockable primary panel and an interlockable bottom panel;

c. a foot flange, having an irregular trapezoidal cross-section, extending downward from said horizontal support; and d. a support surface underneath said semi-panel portion, positioned and sized to abut a top end of an attachment flange of one of an interlockable primary panel and an interlockable bottom panel.

11. A slat wall system comprising:

a. a plurality of primary panels, each having a top end and a bottom end, wherein said bottom end of a first primary panel of said plurality of primary panels is configured to interlock with said top end of a second primary panel of said plurality of primary panels;

b. top and bottom horizontal spaced-apart slots, having a particular spacing defined by a main panel portion, in each primary panel of said plurality of primary panels;

c. a bottom panel comprising a groove for aligning fasteners and operable to interlock to said bottom end;

d. a top panel that does not receive wall fasteners and is operable to interlock to said top end;

e. wherein said top end of each said primary panel of said plurality of primary panels comprises a top interlocking portion and a groove for aligning fasteners;

f. wherein said bottom end of each said primary panel of said plurality of primary panels comprises a bottom interlocking portion and does not receive fasteners;

g. wherein interlocking conceals a fastener when at least two of said plurality of primary panels, said bottom panel, and said top panel are interlocked and fastened to a wall;

h. wherein interlocking top and bottom primary panels of said plurality of primary panels retains said particular spacing between a top slot of said bottom panel and a bottom slot of said top panel;

i. a main panel portion extending from a floor of a top horizontal slot in each primary panel of said plurality of primary panels to a top of an opening of a bottom horizontal slot in each said primary panel of said plurality of primary panels; and j. wherein said top panel provides no support for a primary panel of said plurality of primary panels when installed; and k. a resilient clip, wherein said top panel is fastened to said primary panel of said plurality of primary panels with said clip, wherein said clip comprises a flat portion fastened to a top edge of said primary panel of said plurality of primary panels and an arcuately upwardly extending portion receiving a protrusion of said top panel.

12. The slat wall system of claim 11, wherein said top end of each said primary panel of said plurality of primary panels comprises:

a. an attachment flange having a flat, wall-engaging rear surface, a top end, and a front surface;

b. a horizontal groove in said front attachment flange front surface;

c. a standoff, extending from said attachment flange front surface, sized to accommodate a fastener head;

d. a channel, adjacent and below said standoff, having an irregular trapezoidal cross-section;

e. a top support, extending from a side of said channel distal said standoff, for supporting one of an interlockable primary panel and an interlockable top panel; and f. a top semi-panel portion, extending downward from said top support to said opening of said top horizontal slot.

13. The slat wall system of claim 11, wherein said bottom end comprises:

a. a bottom semi-panel, having a front surface and a rear surface, extending from a floor of said bottom horizontal slot in said primary panel of said plurality of primary panels;

b. a horizontal support extending rearward from said bottom semi-panel portion, operable to abut a top support one of:

i. a particular interlockable primary panel of said plurality of primary panels; and ii. said bottom panel; and c. a foot flange, having an irregular trapezoidal cross-section, extending downward from said horizontal support; and a rear support extending from said semi-panel portion rear surface, positioned and sized to engage a top end of an attachment flange of one of:

i. a particular interlockable primary panel of said plurality of primary panels; and ii. said bottom panel.

14. The slat wall system of claim 11, wherein each said primary panel of said plurality of primary panels is made from a single web having a web thickness.

15. The slat wall system of claim 14, wherein each said primary panel of said plurality of primary panels, said top panel, and said bottom panel has a thickness equal to two and two-thirds said web thickness.

16. The slat wall system of claim 11, wherein each slot of said top and bottom spaced-apart horizontal slots comprises:

a. an opening having a top and a bottom, said opening positioned between a main panel portion and a semi-panel portion of said primary panel of said plurality of primary panels;

b. a floor extending inward from said bottom of said opening; and c. a linear flange extending upward from said opening, creating an upwardly extending flange channel behind said linear flange.

17. The slat wall system of claim 11, comprising a peg having a resilient arcuate base adapted to be coupled between two said spaced apart horizontal slots in at least one primary panel of said plurality of primary panels.

18. The slat wall system of claim 17, wherein said peg further comprises:

a. an upward flange extending from a top of said resilient arcuate base, wherein said flange is sized to engage an upwardly extending flange channel in a first, upper, horizontal slot; and b. an upturned flange extending from a bottom of said resilient arcuate base and sized to engage a floor of a second, lower horizontal slot; and c. at least one elongated member coupled to and extending rigidly outward from said resilient arcuate base;

d. wherein said resilient arcuate base is one of:

i. slotted above said at least one elongated member; and ii. channeled proximate at least one side of said resilient arcuate base.

19. A slat wall system comprising:

a. a plurality of primary panels, each having a top end and a bottom end, wherein said bottom end of a first primary panel of said plurality of primary panels is configured to interlock with said top end of a second primary panel of said plurality of primary panels;

b. wherein:

i. said top end comprises:

1. a vertical attachment flange having a flat, wall-engaging rear surface; a top end; and a front surface;

2. a horizontal groove in said front surface;

3. a standoff, extending from said attachment flange front surface, sized to accommodate a fastener head;

4. a channel, adjacent and below said standoff, having an irregular trapezoidal cross-section;

5. a top support, extending from a side of said channel distal said standoff, for supporting one of an interlockable primary panel and an interlockable top panel; and 6. a top semi-panel portion, extending downward from said top support to an opening of a top horizontal slot in said primary panel;

ii. said bottom end comprises:

1. a bottom semi-panel, having a front surface and a rear surface, extending from a floor of a bottom horizontal slot in said primary panel;

2. a horizontal support extending rearward from said bottom semi-panel portion operable to abut a top support of one of an interlockable primary panel and an interlockable bottom panel;

3. a foot flange, having an irregular trapezoidal cross-section, extending downward from said horizontal support; and 4. a rear support extending from said semi-panel portion rear surface, positioned and sized to abut a top end of an attachment flange of one of an interlockable primary panel and an interlockable bottom panel;

c. top and bottom horizontal spaced-apart slots, having a particular spacing defined by a main panel portion extending from a floor of a top horizontal slot in said primary panel to a top of an opening of a bottom horizontal slot, in each primary panel of said plurality of primary panels;

d. wherein each slot of said top and bottom spaced-apart horizontal slots comprises:
   i. an opening having a top and a bottom, said opening positioned between a main panel portion and a semi-panel portion of said primary panel;
   ii. a floor extending inward from said bottom of said opening; and
   iii. a linear flange extending upward from said opening, creating an upwardly extending flange channel behind said linear flange e. a bottom panel operable to interlock to said bottom end, wherein said bottom panel comprises:
   i. a vertical bottom panel attachment flange having a flat, wall-engaging rear surface, a top end, and a front surface;
   ii. a horizontal groove for aligning fasteners in said front surface;
   iii. a standoff, extending from said bottom panel attachment flange front surface, sized to accommodate a fastener head;
   iv. a bottom panel channel, adjacent and below said standoff, having an irregular trapezoidal cross-section;
   v. a bottom panel top support, extending from a side of said channel distal said standoff, for supporting an interlockable primary panel; and
   vi. a bottom panel front surface descending from said bottom panel top support;

f. a top panel that does not receive fasteners and is operable to interlock to said top end, wherein said top panel provides no support for a primary panel of said plurality of primary panels when installed; and g. a resilient clip, wherein said top panel is fastened to said primary panel of said plurality of primary panels with said clip, wherein said clip comprises a flat portion fastened to a top edge of said primary panel of said plurality of primary panels and an arcuately upwardly extending portion receiving a protrusion of said top panel;

h. wherein interlocking conceals fasteners when at least two of said plurality of primary panels, said bottom panel, and said top panel are interlocked and fastened to a wall;

i. wherein interlocking top and bottom primary panels of said plurality of primary panels retain said particular spacing between a top slot of said bottom panel and a bottom slot of said top panel;

j. a main panel portion extending from a floor of a top horizontal slot in each primary panel of said plurality of primary panels to a top of an opening of a bottom horizontal slot in each said primary panel of said plurality of primary panels; and k. wherein each said primary panel is made from a single web having a web thickness and each said primary panel, said top panel, and said bottom panel has a thickness equal to two and two-thirds said web thickness.

20. The slat wall system of claim 19, comprising a peg having a resilient arcuate base adapted to be coupled between two said horizontal slots in at least one primary panel of said plurality of primary panels; wherein said peg further comprises:

a. an upward flange extending from a top of said resilient arcuate base, wherein said flange is sized to engage an upwardly extending flange channel in a first, upper, horizontal slot; and b. an upturned flange extending from a bottom of said resilient arcuate base and sized to engage a floor of a second, lower horizontal slot; and c. at least one elongated member coupled to and extending rigidly outward from said resilient arcuate base;

d. wherein said resilient arcuate base is one of:
   i. slotted above said at least one elongated member; and
   ii. channeled proximate at least one side of said resilient arcuate base.

* * * * *